US006110534A

United States Patent [19]

Ohmi et al.

[11] Patent Number: 6,110,534

[45] Date of Patent: Aug. 29, 2000

[54] METHOD AND APPARATUS FOR MODIFYING SURFACE MATERIAL

[75] Inventors: Tadahiro Ohmi, 1-17-301, Ko-megabukuro 2-chome, Aoba-ku, Sendai-shi, Miyagi-ken 980; Yoshinori Nakagawa, Miyagi-ken, both of Japan

[73] Assignee: Tadahiro Ohmi, Miyagi-ken, Japan

[21] Appl. No.: 08/901,341

[22] Filed: Jul. 28, 1997

Related U.S. Application Data

[63] Continuation of application No. 08/387,706, Mar. 22, 1995, abandoned.

[30] Foreign Application Priority Data

Aug. 1, 1992 [JP] Japan ..... 4-238973

[51] Int. Cl.[7] ..... B05D 3/02

[52] U.S. Cl. ..... 427/372.2; 427/377; 427/443.2

[58] Field of Search ..... 427/372.2, 377, 427/443.2

[56] References Cited

U.S. PATENT DOCUMENTS 5,051,134 9/1991 Schnegg et al. ..... 134/3
5,092,937 3/1992 Oguno et al. ..... 134/30
5,160,429 11/1992 Ohmi et al. ..... 210/137

FOREIGN PATENT DOCUMENTS 4-234122 9/1992 Japan ..... H01L 21/304
1-45130 2/1999 Japan ..... H01L 21/316

*Primary Examiner*—Benjamin Utech
*Attorney, Agent, or Firm*—Baker & Daniels

[57] ABSTRACT

A method and an apparatus for modifying a surface layer formed on the surface of a base material in order to modify the characteristics of the surface layer such as to control the chemical composition of the surface layer and to develop a novel utilization of ultra-pure water.

The method includes the step of contacting a surface layer on a base material with ultra-pure water in an oxygen-free atmosphere. The amount of dissolved oxygen in the water is preferably 1 ppm or below, and the ultra-pure water is preferably boiled.

The apparatus includes a chamber having inert gas introduction means for introducing an inert gas thereinto, and inert gas discharge means for discharging the inert gas therefrom, a container disposed inside the chamber for holding ultra-pure water, and heating means disposed in the chamber for heating ultra-pure water held in the ultra-pure water container.

11 Claims, 14 Drawing Sheets

METHOD AND APPARATUS FOR MODIFYING SURFACE MATERIAL

This is a continuation of application Ser. No. 08/387,706, filed Mar. 22, 1995 now abandoned.

FIELD OF THE INVENTION

The present invention relates to a method and apparatus for modifying surface material.

TECHNOLOGICAL BACKGROUND

Conventionally ultra-pure water is used for diluting chemicals (for instance for diluting 98% sulfuric acid to a desired density) or for preparing chemicals (for instance dissolving sodium hydroxide to prepare a 1 N sodium hydroxide sodium), for washing vessels such as a beaker or a tank, or for removing a chemical solution or residue of a chemical solution from a surface of a silicon wafer steeped into a chemical solution. Also ultra pure water is used as a raw material for obtaining hydrogen or oxygen by means of electroanalysis. Thus, a range of use of ultra pure water is rather narrow.

On the other hand, modification of characteristics of a surface material formed on a metallic material (such as control of the composition of the surface material) is executed by controlling a gas element or a reaction temperature when the surface material is formed, or making the surface react with other gas after the surface material is formed.

FIG. 13 shows an XPS analysis diagram for a surface material in a case where composition control is executed by changing the gas after a reaction for generation of the surface material. FIG. 13A is an XPS analysis diagram for a case where SUS 316L is reacted to fluorine gas for 8 minutes under a temperature of 220° C., and FIG. 13B shows a case where a thermal processing is executed, after the processing in FIG. 13A, for 24 hours in a nitrogen atmosphere under a temperature of 400° C. In case of the surface shown in FIG. 13A, a ratio of Fe vs F is 1:2.27 indicating a non-stoichiometric structure, while the surface shown in FIG. 13B has an Fe Vs F ratio of 1:2.00 indicating a stoichiometric structure of $FeF_2$.

FIG. 14 shows a result of comparison between a compound having a stoichiometric structure and that having a non-stoichlometric structure by exposing them to a fluorine gas and checking the barrier effect to the fluorine gas in terms of consumption pressure of a fluorine gas. As clearly shown in FIG. 14, in case of a surface having astoichiometric structure as indicated by the white circle, a pressure of fluorine is constant, and consumption of fluorine gas is not observed, however, in case of a non-stoichiometric structure as indicated by the black circle, a pressure of fluorine gas decreases in association of elapse of time, which indicates consumption of fluorine gas. Namely a surface not having a stoichiometric structure dose not have a barrier effect against a fluorine gas. Thus a surface having a stoichiometric structure is stable. However, in the conventional method, a long time processing under a high temperature is required.

It is an object of the present invention to provide a method of modifying a surface material and an apparatus for the same enabling easy modification of characteristics of a surface material (control of chemical composition of a surface material) and new application of ultra pure water.

DESCRIPTION OF THE REFERENCE NUMERALS

1: Chamber
2: Vessel for ultra-pure water
3: Contents
4: Ultra-pure water
5: Inert gas inlet port (inert gas introducing means)
6: Inert gas outlet port (inert gas discharging means)
7: Means for heating ultra-pure water

DISCLOSURE OF THE INVENTION

A surface material modifying method according to the present invention is characterized in that a surface material formed on a metallic material is contacted in an atmosphere not containing oxygen to ultra pure water.

The surface material modifying apparatus according to the present invention comprises at least a chamber having an inert gas for introducing an inert gas into the inside thereof and an inert gas discharging means for discharging the inert gas to the outside thereof, a vessel for ultra-pure water for maintaining ultra-pure water located inside the chamber, and a means for heating ultra pure water maintained in the vessel for ultra pure water located inside the chamber.

Herein the metallic material is selected from a group consisting of, for instance, nickel, chromium, iron, aluminium, copper, and an alloy containing one or more of the materials described above as a main component.

Also the surface material includes, for instance, nickel fluoride, chromium fluoride, iron fluoride, aluminium fluoride, and copper fluoride.

Atmosphere not including oxygen is realized by introducing an inert gas (a gas such as oxygen, argon, and helium or the like) into a chamber in which ultra-pure water is located. An inert gas may be located in an inert gas atmosphere, or may be flown in a closed vessel on that condition that the ultra pure water is not exposed to air.

In ultra-pure water, the specific resistance should preferably be higher than 18 (MΩ.cm at 25° C.). Also content of granules each having a diameter of 0.2 μm or more should preferably be 30 pieces/ml or more. A number of living bacteria should preferably be 10 (pieces/100 ml) or less, and more preferably be 1 (piece/100 ml) or less.

In the present invention, a surface material having a chemically stable structure can easily be obtained by steeping a metallic material into ultra-pure water in a state where an oxidizing atmosphere is controlled, and also a new field for use of ultra pure water can be provided.

As an example of improvement, there is a method in which a metallic material is steeped into ultra pure water with a density of oxygen dissolved therein put under control under the presence of an inert gas. In this method, a density of dissolved oxygen in the ultra-pure water should be less than 8 ppm. Temperature of the ultra-pure water is preferably higher than 50° C. The processing time may be in a range from several minuted to several hours. With this method, it is possible to control composition of a material on a surface of a metallic material.

BEST MODE FOR CARRYING OUT THE PRESENT INVENTION

Further detailed description is made for embodiments of the present invention.

Figure 1:
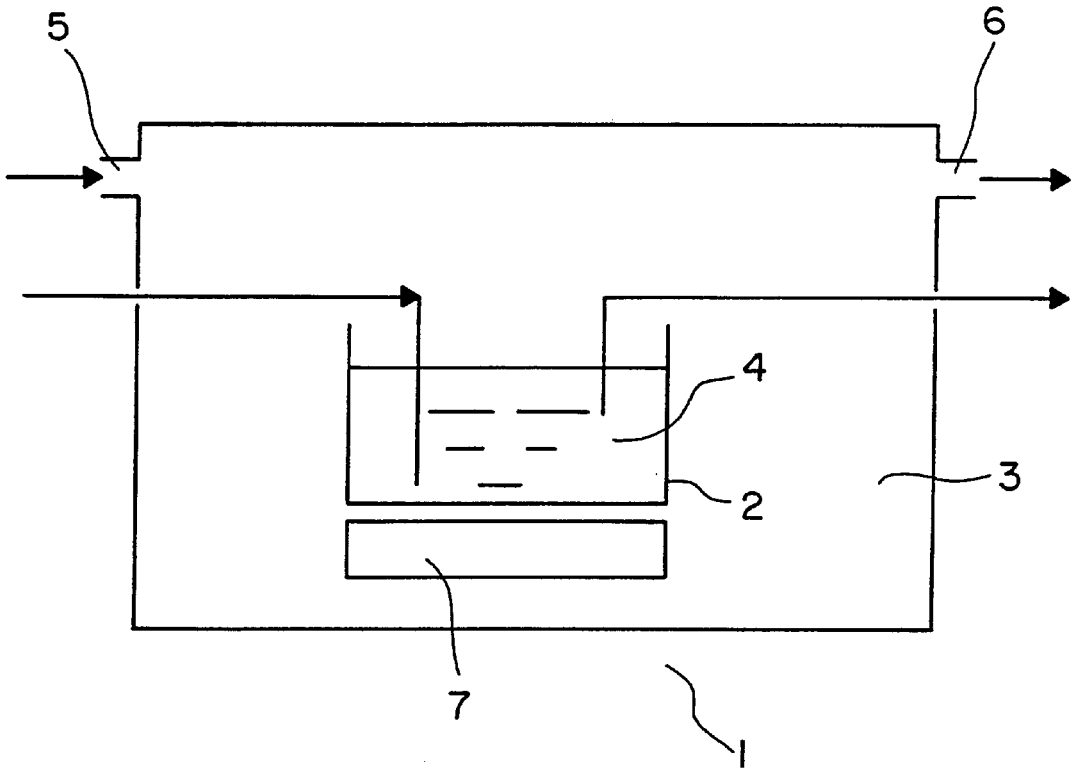
FIG. 1 is a concept diagram illustrating an apparatus for modifying a surface material according to an embodiment of the present invention.

First, an embodiment of the apparatus according to the present invention is shown in FIG. 1.

The apparatus in this embodiment comprises at least a chamber 1 comprising an inert gas inlet port 5 (inert gas introducing means) for introducing an inert gas into the inside thereof and an inert gas outlet port 6 (inert gas discharging means), a vessel 2 for ultra-pure water for maintaining ultra-pure water 4 located inside 3 the chamber 4, and a means 7 for heating the ultra pure water 4 maintained in the vessel 2 for ultra-pure water located inside 3 the chamber 1.

By introducing an inert gas such as nitrogen or argon from the inert gas inlet port 5 into inside 3, it is possible to prevent the ultra pure water from being contacted to air. In this state, the metallic material with a surface material formed thereof is steeped into the ultra pure water 4. The ultra pure water 4 is heated by the means 7 for heating the ultra pure water to excel oxygen dissolved in the ultra-pure water therefrom. It should be noted that the oxygen expelled from the ultra-pure water is discharged by the inert gas from the inert gas outlet port to outside of the chamber 1.

Next description is made for embodiments of the present invention together with comparison examples.

COMPARISON EXAMPLE 1

Ni—W—P plating was applied on aluminium, and furthermore fluoridation was executed. Fluoridation was executed under the following conditions.

An oxidized film on a surface of the plating was steeped into 0.5% fluoric acid solution for one minutes, washed, and then dried in nitrogen gas under a temperature of 250° C. Then fluoridation was executed for 8 hours under a temperature of 350° C. in 100% nitrogen gas. After fluoridation, heat treatment was for 12 hours under a temperature of 350° C.

Figure 2A:
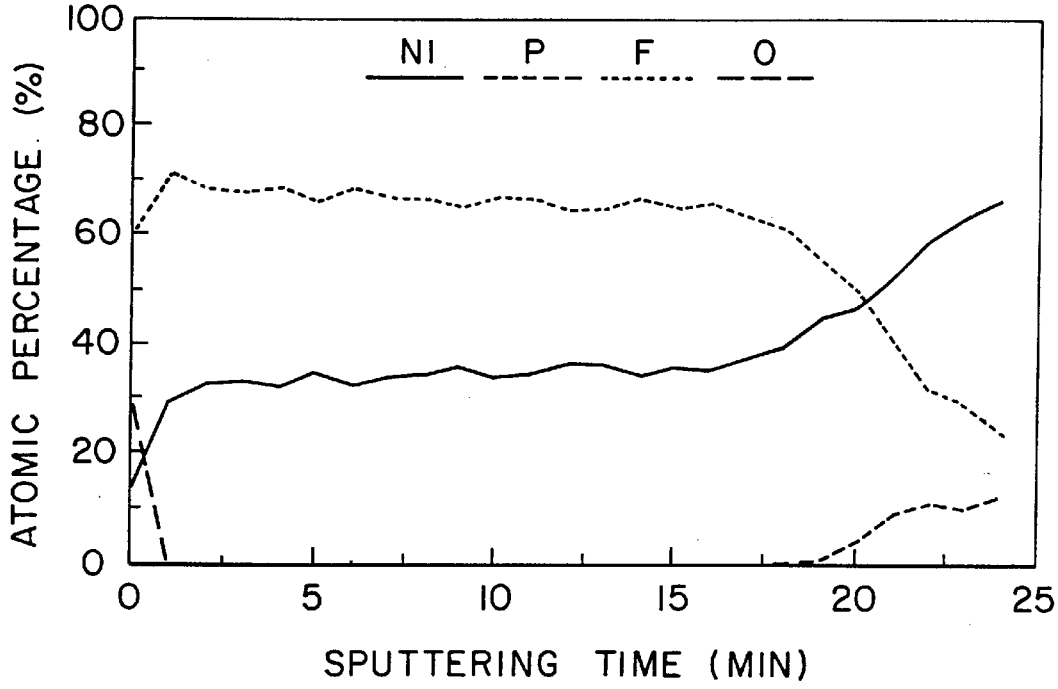
FIG. 2 is an XPS analysis diagram for a surface material formed in Comparison example 1.
Figure 2B:
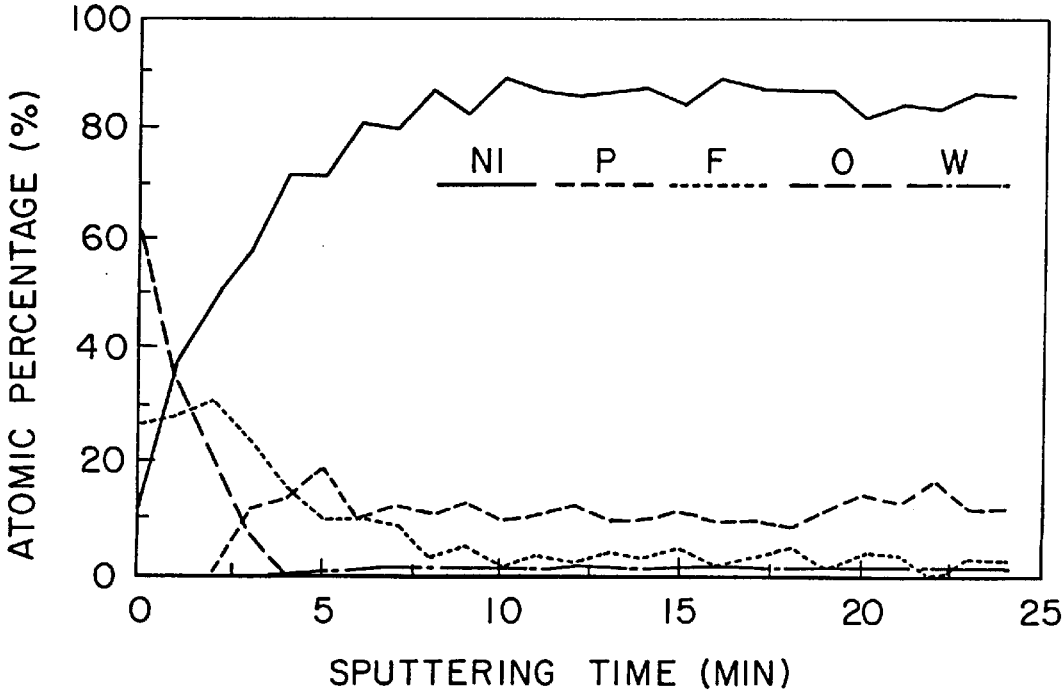

$NiF_2$ was formed on the surface, The sample was steeped under atmosphere into ultra pure water, and boiled for 5 hours. An XPS analysis drawing for the surface material formed under the conditions as described above is shown in FIG. 2. FIG. 2A shows a state before the ultra pure water was boiled, while FIG. 2B shows a state after the ultra pure water was boiled. As clearly shown in this figure, not only the film thickness was reduced, but also the film contained oxygen. It should be noted that the sputtering speed in sputtering in FIG. 2 was 120 angstroms/min, and the sputtering speed in other figures was also 120 angstroms per minute.

(Embodiment 1)

Figure 3A:
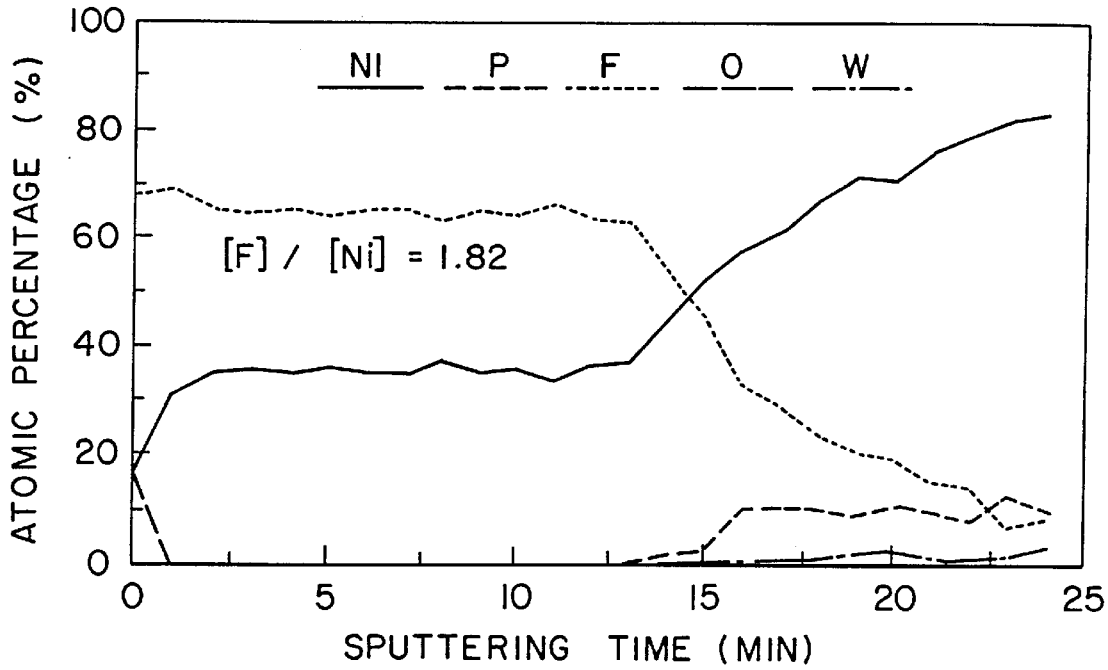
FIG. 3 is an XPS analysis diagram for a surface material formed in Embodiment 1.
Figure 3B:
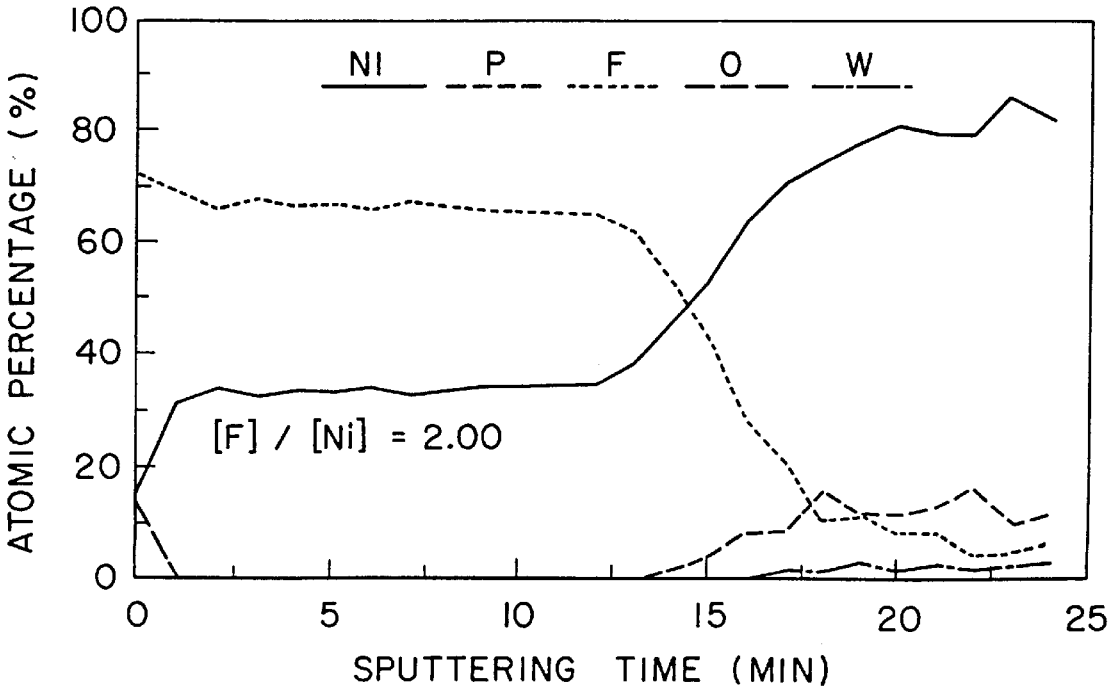

A sample with an $FiN_2$ film formed on the surface thereof by applying Ni—W—P plating to aluminium and then executing fluoridation thereto was steeped into ultra pure water containing dissolved oxygen by 1 ppm in nitrogen gas atmosphere, and was boiled for 1 hour with the ultra pure water containing dissolved oxygen by 1 ppm flowing. FIG. 3 shows an XPS analysis drawing for the surface material formed under the conditions described above. FIG. 3A shows a state before the ultra pure water was boiled, while FIG. 3B shows a state after the ultra pure water was boiled. As clearly shown in the figures, by boiling the sample containing dissolved oxygen by 1 ppm, an Ni vs F ratio was changed to 1:2, indicating change of the composition to the stoichiometric structure of $NiF_2$.

(Embodiment 2)

Figure 4A:
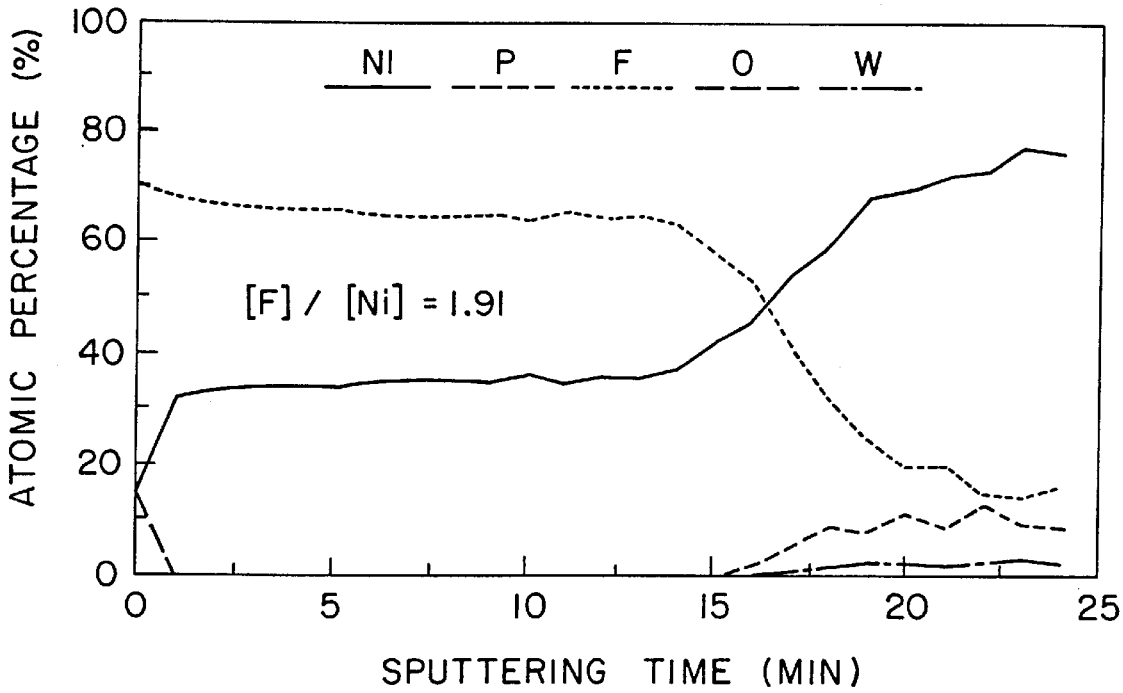
FIG. 4 is an XPS analysis diagram for a surface material formed in Embodiment 2.
Figure 4B:
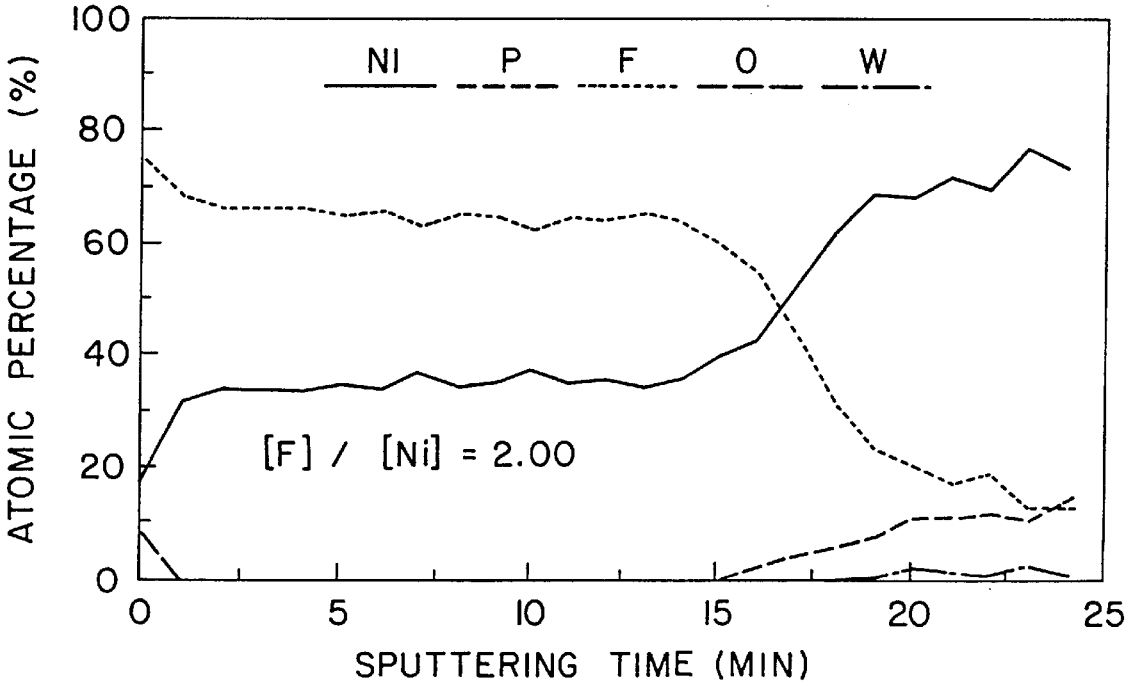

A sample with an $FiN_2$ film formed on the surface thereof by applying Ni—W—P plating to aluminium and then executing fluoridation thereto was steeped into ultra pure water containing dissolved oxygen by 1 ppb in an atmosphere not contacting air (in a closed vessel), and was boiled for 1 hour with the ultra-pure water containing dissolved oxygen by 1 ppb flowing. FIG. 4 shows an XPS analysis drawing for the surface material formed under the conditions as described above. FIG. 4A shows a state before the ultra pure water was boiled, while FIG. 4B shows a state after the ultra pure water was boiled. As clearly shown in this figure, by boiling the sample in ultra pure water containing dissolved oxygen by 1 ppb, the Ni vs F ratio was changed to 1:2, indicating change of the composition to the stoichiometric structure of $NiF_2$.

Figure 5:
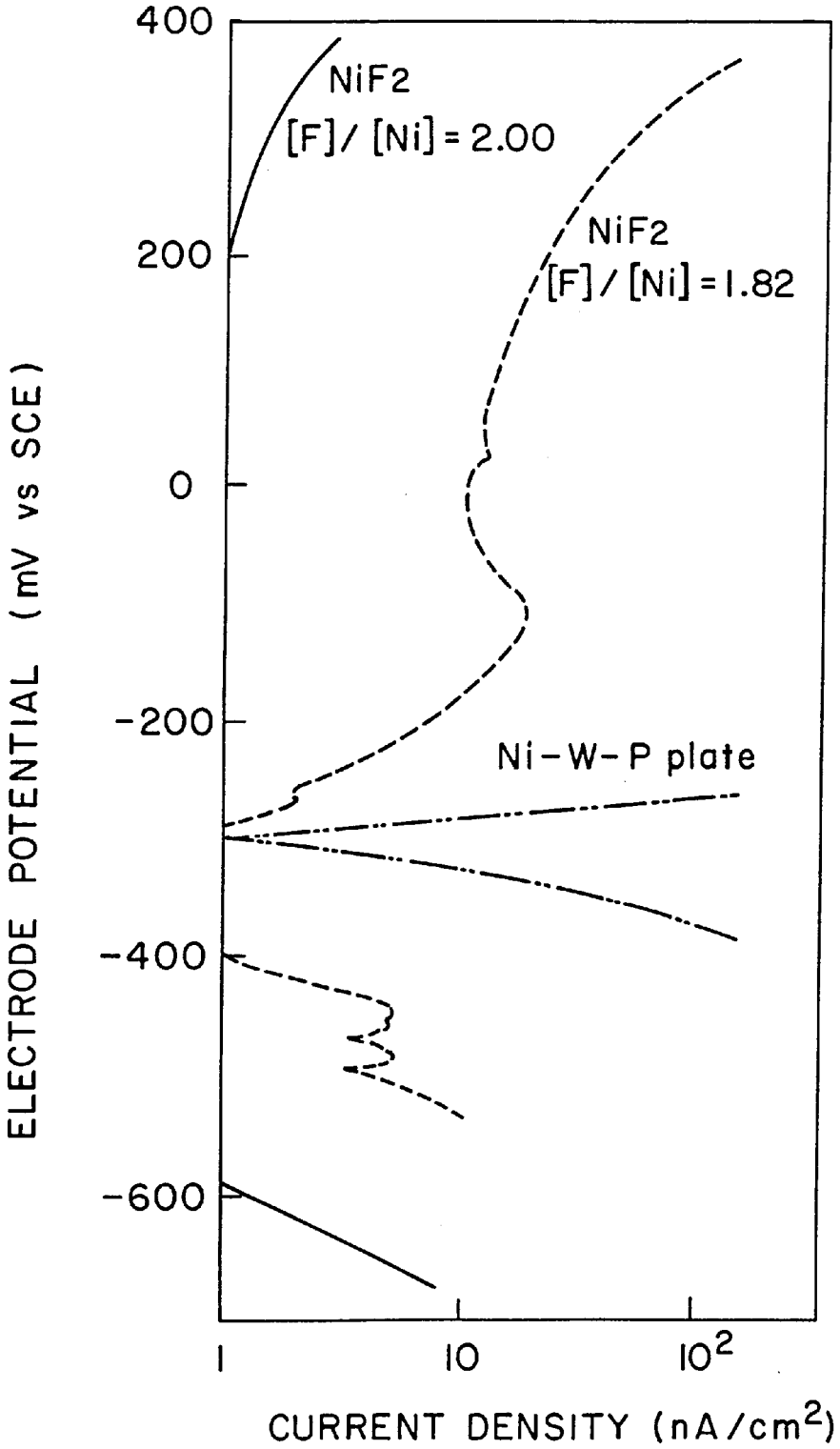
FIG. 5 is a polarization curve diagram for a surface material formed in Embodiment 2.

A difference in terms of corrosion stability between the surface formed in Embodiment 1 and a surface prior to processing with ultra pure ware was checked by steeping the samples into a 1 N $AlCl_3$ solution. The polarization curve was shown in FIG. 5. As clearly shown in the figure, in the surface formed in Embodiment 1 and having a stoichiometric structure, a corrosion current does not flow in a range from −600 mV to 200 mV, indicating the excellent corrosion stability.

Figure 6A:
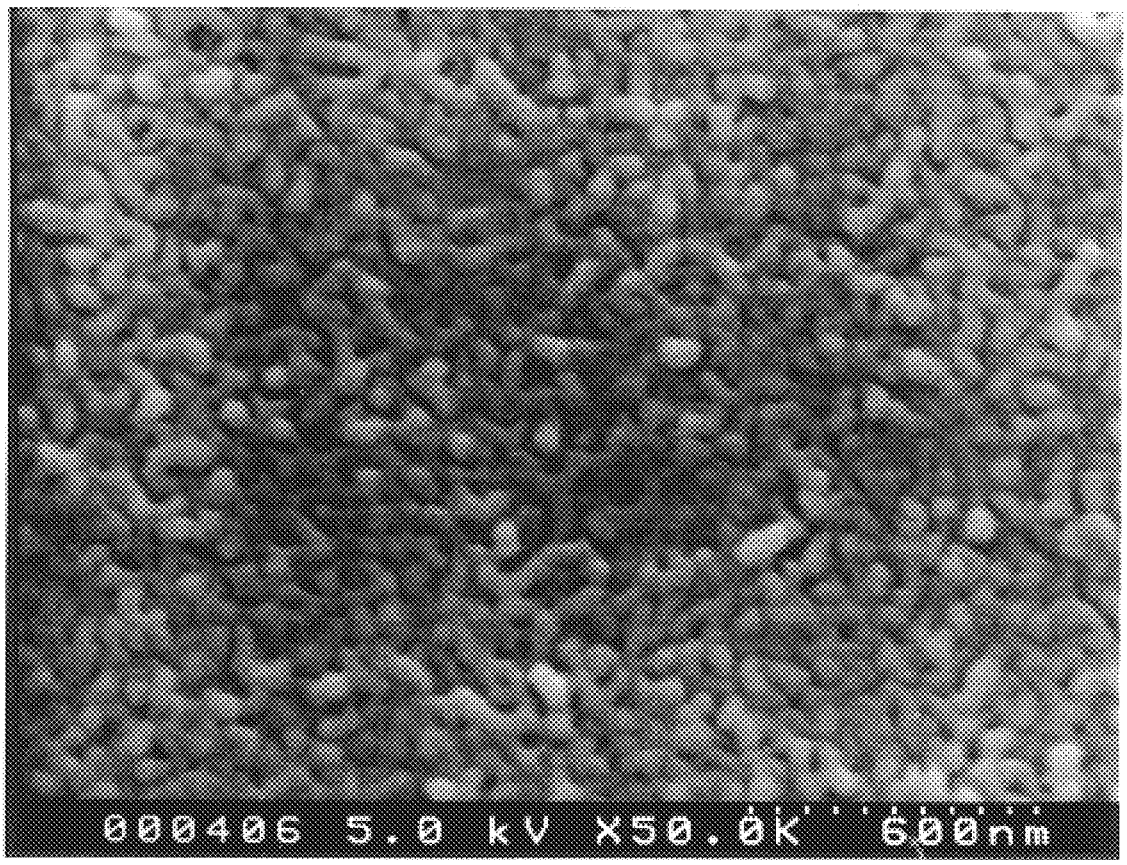
FIG. 6 is an SEM surface photograph of a surface material formed in Embodiment 2.
Figure 6B:
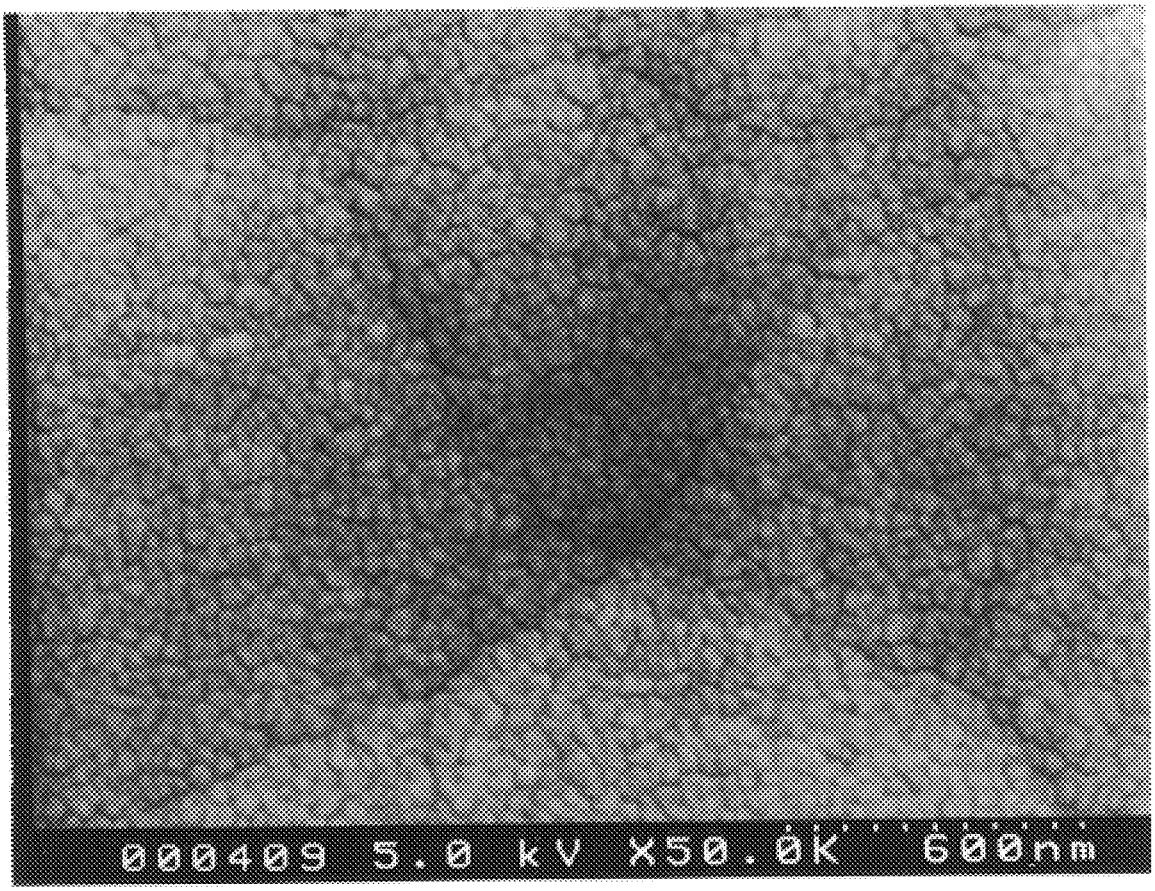
Figure 6C:
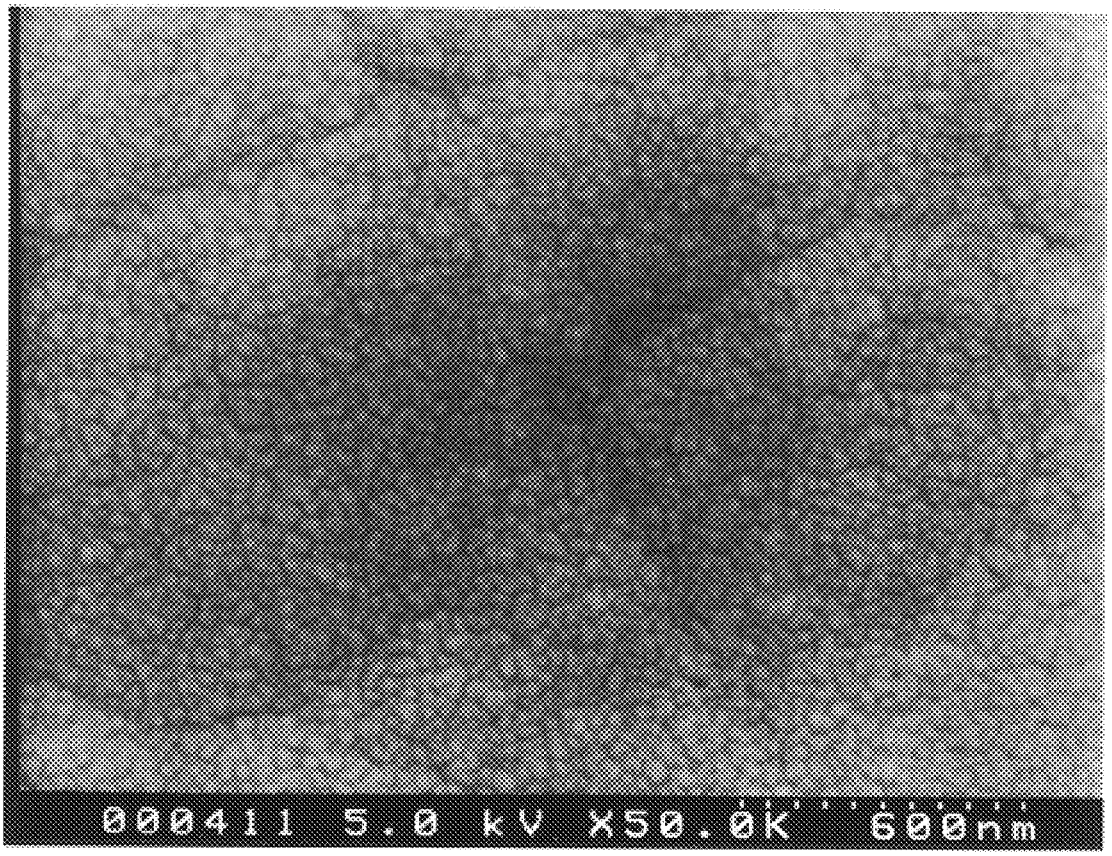

A surface formed after boiling in air and that formed after boiling in inert gas atmosphere were observed with a scanning electronic microscope (SEM). Photographs of the surfaces are shown in FIG. 6. FIG. 6A shows a state of the surface boiled in air, while FIG. 6B shows a surface boiled in ultra pure water containing dissolved oxygen by 1 ppm and FIG. 6C shows a surface boiled with ultra pure water containing dissolved oxygen by 1 ppb in inert gas atmosphere. In the surface boiled in air, crystal granules are large, and pit-like gaps can be observed, but the surface processed by boiling in inert gas atmosphere is homogeneous.

(Embodiment 3)

Figure 7A:
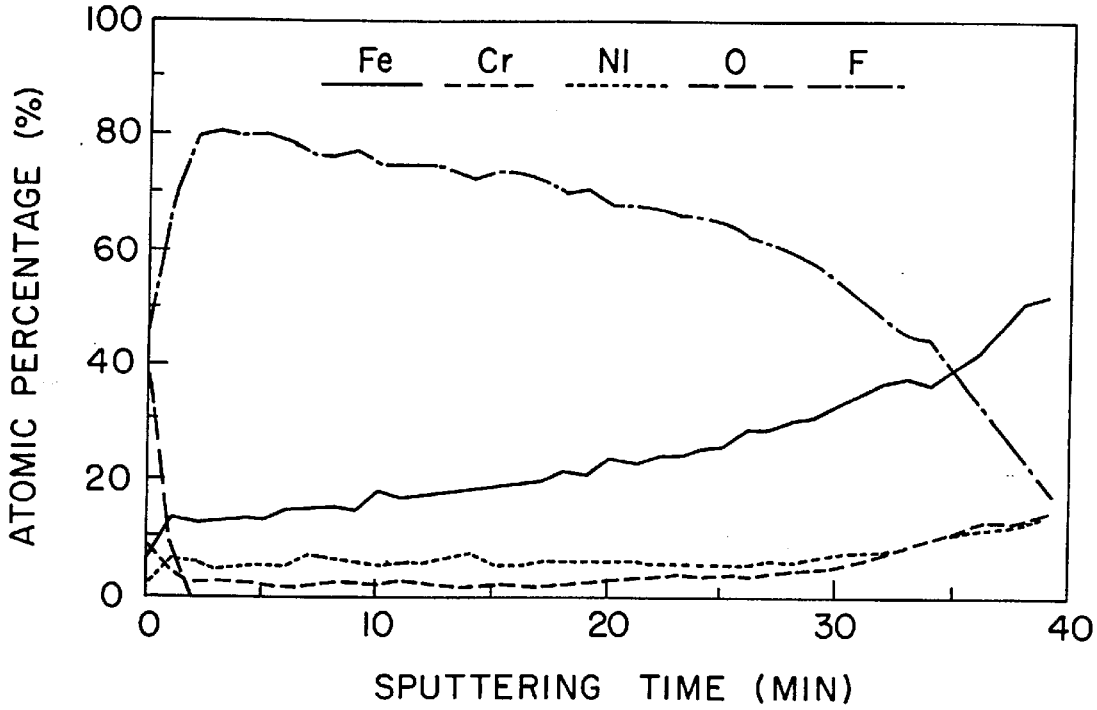
FIG. 7 is an XPS analysis diagram illustrating a state of a surface material formed in Embodiment 3 before and after a processing with ultra pure water.
Figure 7B:
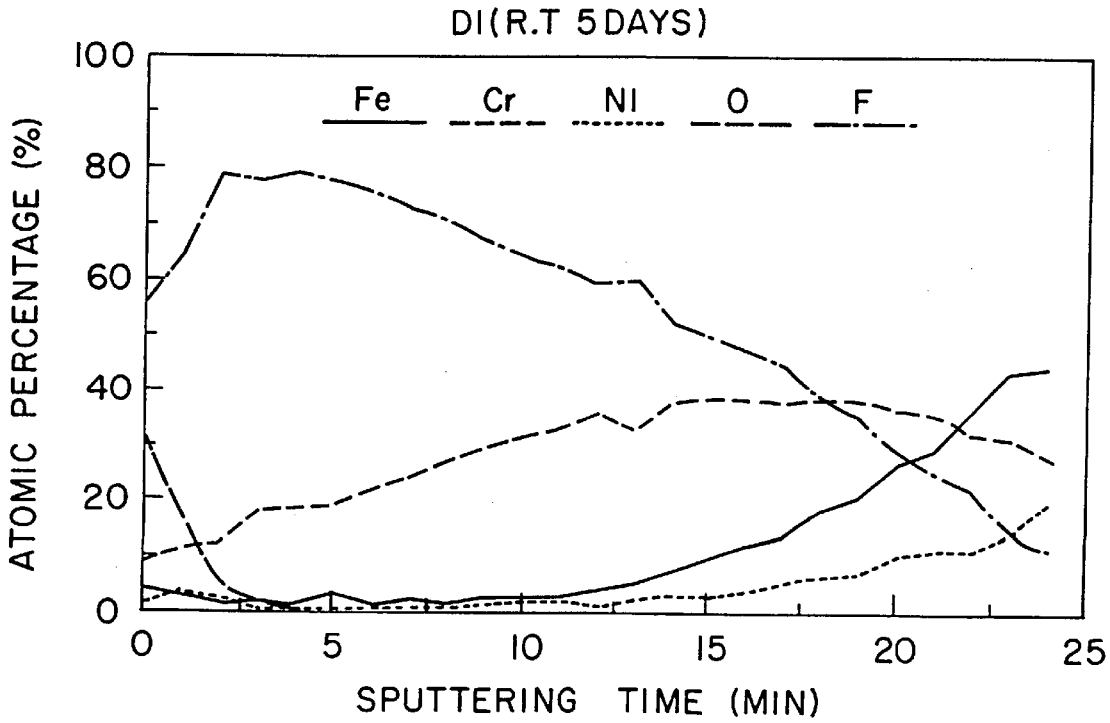
Figure 8A:
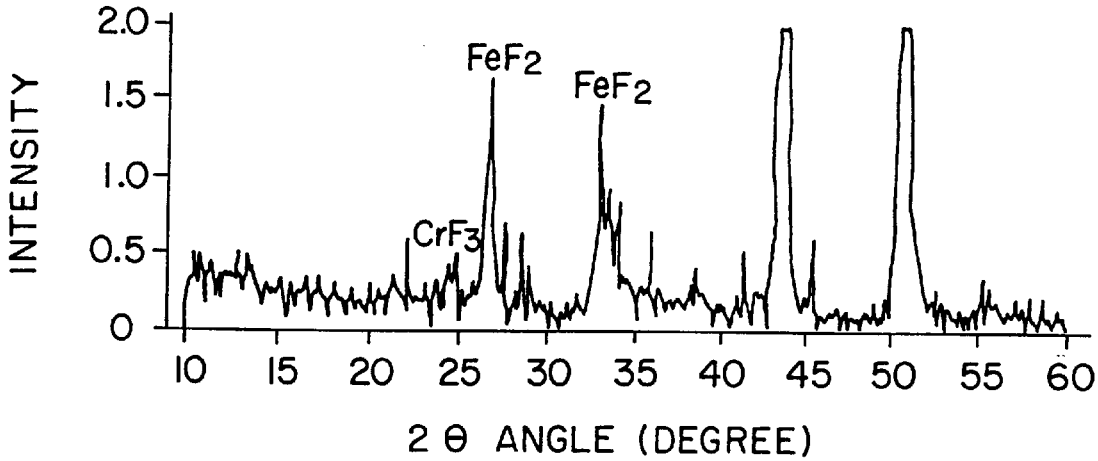
FIG. 8 is an XRD analysis diagram of a surface material formed in Em processing with ultra-pure water.
Figure 8B:
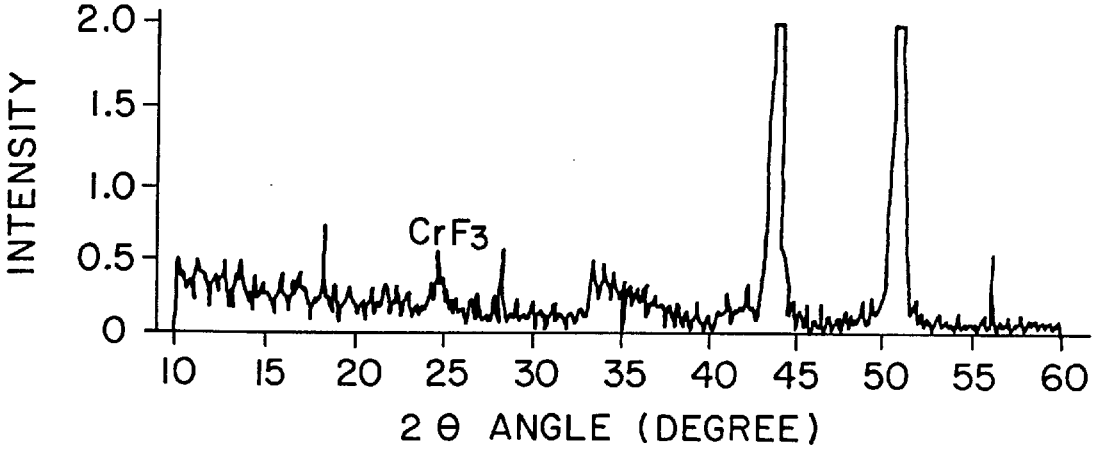

A sample was obtained by fluoridating stainless steel (SUS316L) This sample was steeped into ultra pure water containing dissolved oxygen by 1 ppm for 5 hours under the room temperature in nitrogen atmosphere. FIG. 7 shows an XPS analysis drawing for the sample before and after processing with the ultra pure water, while FIG. 8 shows an XRD analysis drawing for the sample before and after processing with ultra pure water. FIG. 7 and FIG. 8A show a surface of the sample before processing with ultra pure water, while FIG. 8B shows a surface after processing with ultra pure water. By steeping the sample into ultra pure water in atmosphere suppressing oxidation, the film containing $FeF_2$ as a main component was changed to a passive state film containing $CrF_3$ as a main component.

Figure 9:
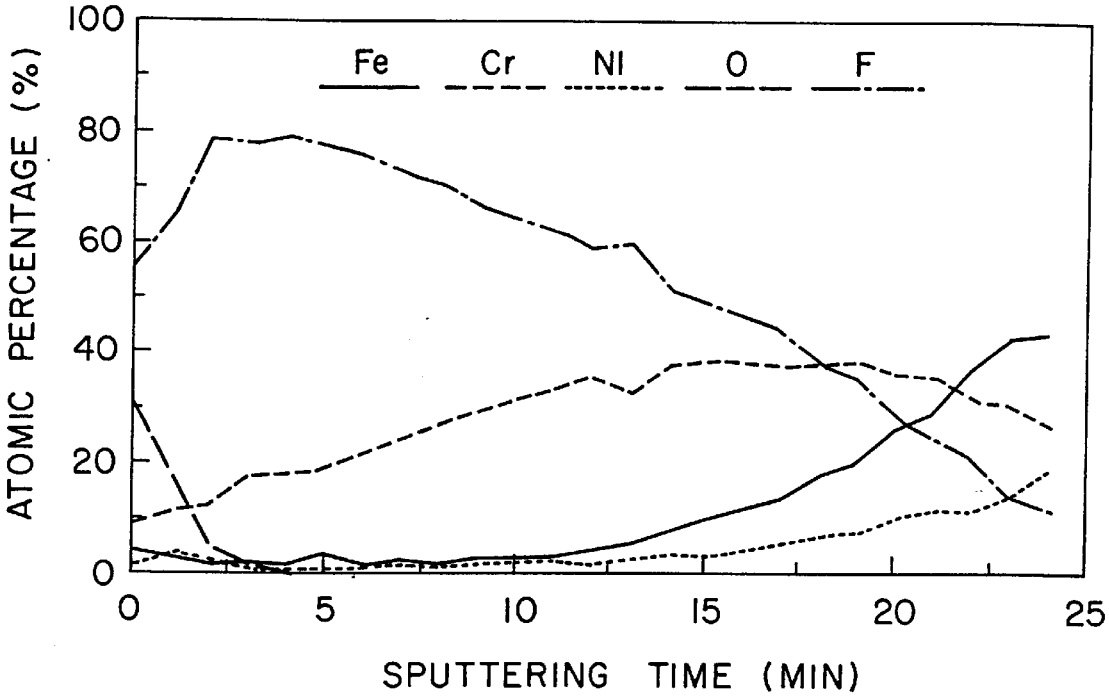
FIG. 9 is an XPS diagram of a surface material formed in Embodiment 3 after a withstand corrosion test thereof.
Figure 10:
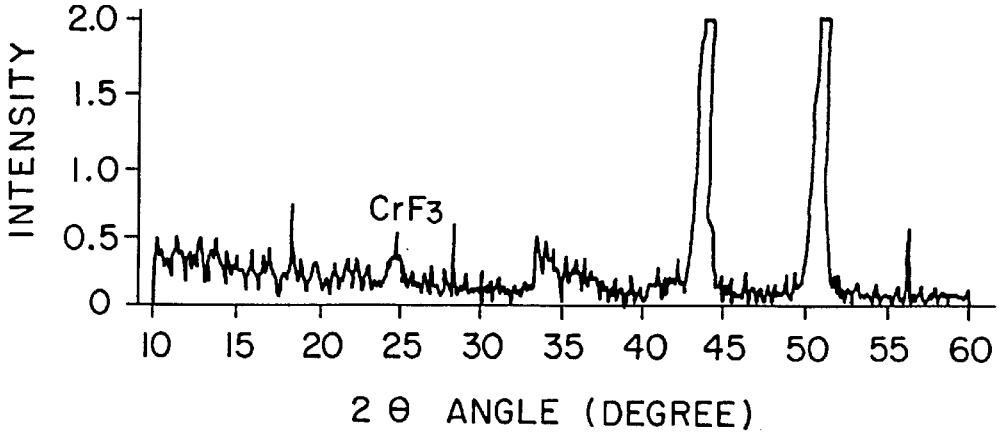
FIG. 10 is an XRD analysis diagram of a surface material formed in Embodiment 3 after a withstand corrosion test thereof.

The passive state film formed in this embodiment was steeped into a 5% HF aqueous solution for 5 hours under a temperature of 25° C., and the corrosion stability was checked. FIG. 9 shows an XPS analysis drawing after the corrosion stability test. FIG. 10 shows an XRD analysis drawing for the same sample. No difference is observed between the analysis drawing before the corrosion stability test (FIG. 8B and FIG. 8) and FIG. 9 and FIG. 10 each showing a state after the corrosion stability test. For this reason, the excellent corrosion stability was recognized against the 5% HF aqueous solution having strong corrosiveness was recognized.

COMPARISON EXAMPLE 2

Figure 11:
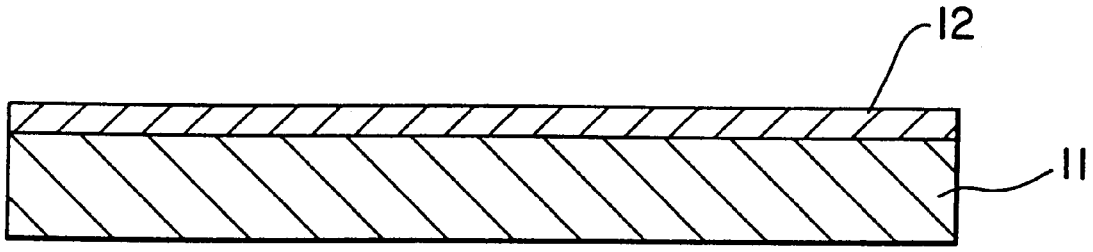
FIG. 11 is a concept diagram illustrating a chrome sputter film formed by sputtering.
Figure 12:
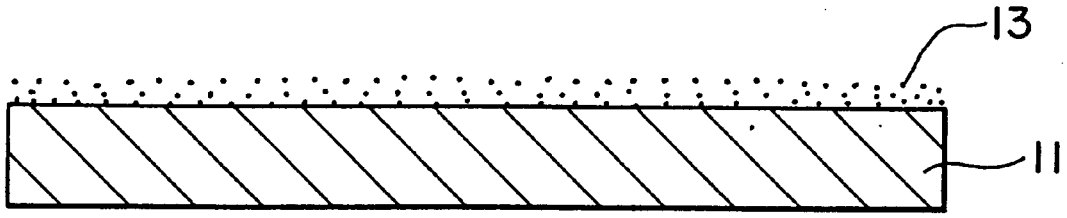
FIG. 12 is a concept diagram illustrating a case where a chrome sputter film formed by sputtering is fluoridated.
Figure 13A:
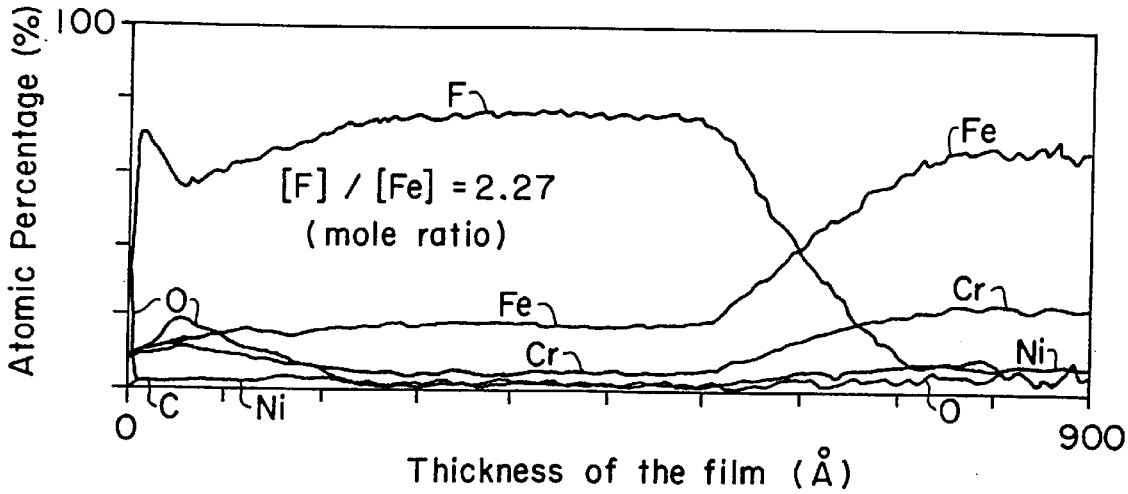
FIG. 13 is an XPS analysis diagram of a surface material in a case where composition control is executed by changing a gas after a reaction for generation thereof.
Figure 13B:
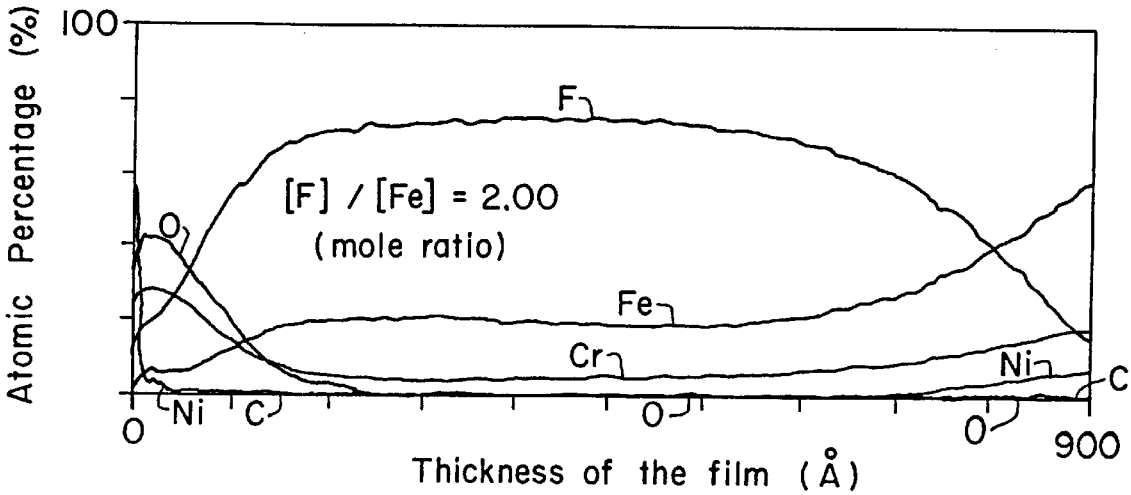
Figure 14:
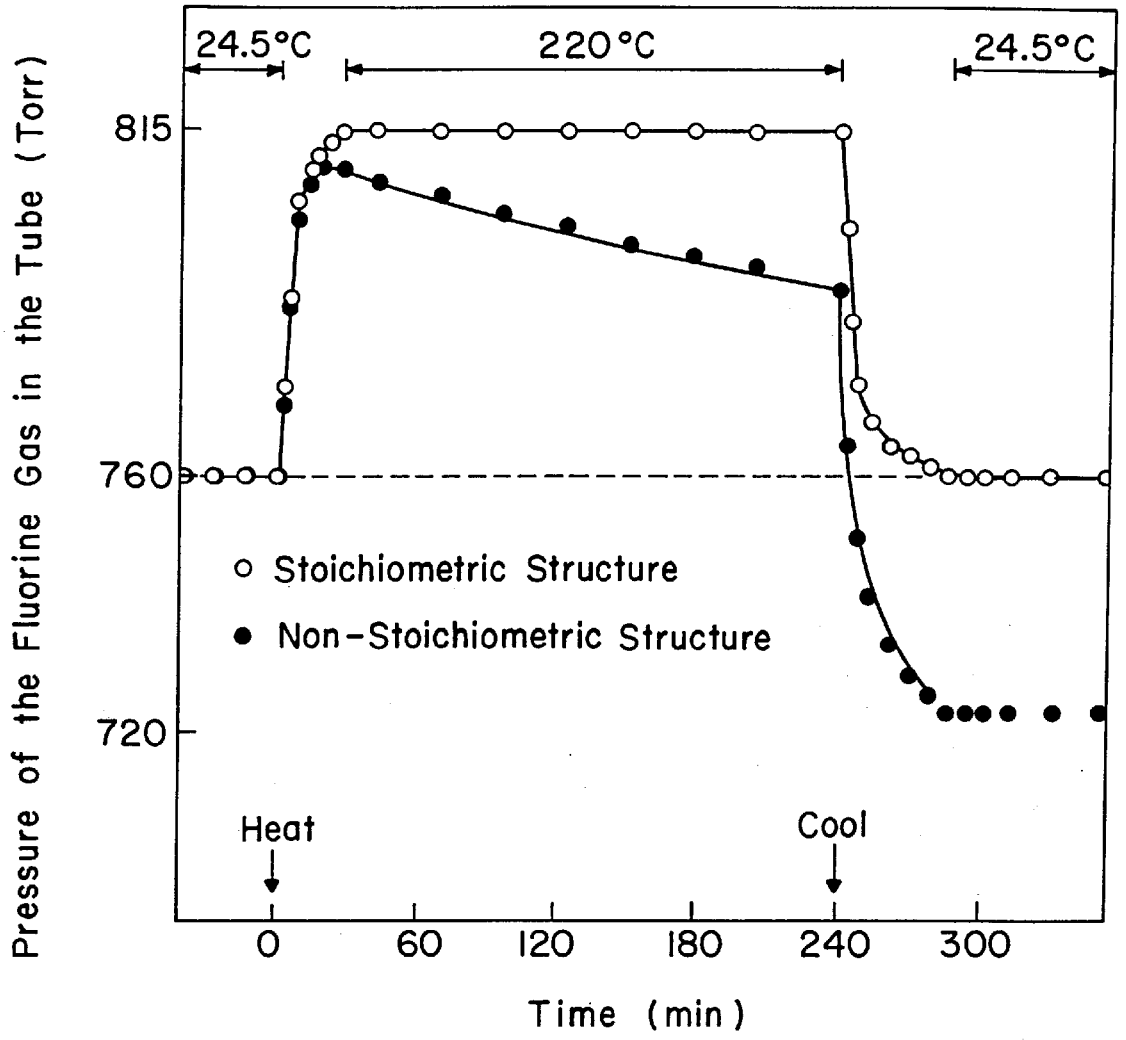
FIG. 14 is a graph illustrating a difference of a barrier effect against a fluorine gas in terms of consumption pressure of the fluorine gas between a surface material having a stoichiometric structure and that not having a stoichiometric structure by checking a consumption pressure of fluorine gas compared by exposing each surface material to the fluorine gas.

FIG. 11 and FIG. 12 show a result of fluoridation of pure chromium formed on stainless steel (SUS316L) and Si wafer by means of sputtering. It should be noted that FIG. 11 shows a chrome sputter film formed by sputtering while FIG. 12 shows a state of the film after fluoridation. Also it should be noted that in these figures the reference numeral 11 indicates a stainless steel or a Si wafer, 12 indicates a chrome sputter film, and 13 indicates a fluoridated film. When pure chrome is fluoridated, low boiling point and higher fluoridates such as $CrF_4$, $CrF_5$ or the like are formed successively, and for this reason a fluoridated passive state film can not be formed.

INDUSTRIAL AVAILABILITY

By controlling composition of a metallic surface material with ultra-pure water according to the present invention, the composition can easily be reformed within a short period of time under a low temperature to that of a chemically stable stoichiometric structure. Also a new field for use of ultra pure water was found out. Namely an effect as an industrial application technology for ultra pure ware can be expected.

What is claimed is:

1. A method of modifying a surface layer formed on a surface of a base material, comprising the steps of:

providing a base material having a surface layer of metal fluoride formed on a surface thereon;

providing ultra pure water in a container;

placing the container in an oxygen-free atmosphere; and placing said metal fluoride surface layer in contact with the ultra pure water in said oxygen-free atmosphere.

2. A method of modifying a surface layer according to claim 1, wherein said step of providing ultra pure water comprises providing ultra pure water having dissolved oxygen content of 1 ppm or less.

3. A method of modifying a surface layer according to claim 2, further comprising the step of heating the ultra pure water.

4. A method of modifying a surface layer according to claim 2, wherein said step of providing a base material comprises providing a base material having a surface layer of metal fluoride which is formed by metallic plating and fluoridation.

5. A method of modifying a surface layer according to claim 1, further comprising the step of heating the ultra pure water.

6. A method of modifying a surface layer according to claim 5, wherein said step of heating the ultra pure water comprises heating the water to the boiling point of the water.

7. A method of modifying a surface layer according to claim 6, wherein said step of providing a base material comprises providing a base material having a surface layer of metal fluoride which is formed by metallic plating and fluoridation.

8. A method of modifying a surface layer according to claim 5, wherein said step of providing a base material comprises providing a base material having a surface layer of metal fluoride which is formed by metallic plating and fluoridation.

9. A method of modifying a surface layer according to claim 1, wherein said metal fluoride is a fluoride containing one of nickel fluoride, chromium fluoride, iron fluoride, aluminium fluoride, and copper fluoride as a main component.

10. A method of modifying a surface layer according to claim 1, wherein said step of providing a base material comprises providing a stainless steel base material having a surface layer of metal fluoride and containing one of chrome fluoride and iron fluoride as a main component.

11. A method of modifying a surface layer according to claim 1, wherein said step of providing a surface layer of metal fluoride comprises providing nickel fluoride formed by subjecting a second metallic material formed on said base material by means of plating to fluoridation.

* * * * *

UNITED STATES PATENT AND TRADEMARK OFFICE

CERTIFICATE OF CORRECTION

PATENT NO. : 6,110,534
DATED : August 29, 2000
INVENTOR(S) : Tadahiro Ohmi and Yoshinori Nakagawa It is certified that error appears in the above-identified patent and that said Letters Patent is hereby corrected as shown below:

Column 1,
Line 54, change "dose" to --does--
Line 64, change "DRAWING" to --DRAWINGS--

Column 2,
Line 15, change "Em" to --embodiment 3--
Line 47, change "DISCLOSURE' to --SUMMARY--

Column 3,
Line 5, change "flown in" to --supplied to--
Line 41, insert --heating-- before "means"
Line 49, insert --heating-- before "means"
Line 50, change "excel" to --expel--
Line 66, insert --conducted-- before "for"

Column 4,
Line 45, change "ware" to --water--
Line 47, change "was" to --is--

Column 5,
Line 38, delete the heading "INDUSTRIAL AVAILABILITY"
Line 46, change "ware" to --water--

Signed and Sealed this

Seventh Day of August, 2001

*Attest:*

Nicholas P. Godici

*Attesting Officer*

NICHOLAS P. GODICI
*Acting Director of the United States Patent and Trademark Office*